United States Patent [19]

Allen

[11] Patent Number: 4,825,886

[45] Date of Patent: May 2, 1989

[54] WIG

[76] Inventor: Jan W. Allen, 265 N. 110th St., Wauwatosa, Wis. 53226

[21] Appl. No.: 884,050

[22] Filed: Jul. 9, 1986

[51] Int. Cl.[4] ..... A41G 5/00

[52] U.S. Cl. ..... 132/54; 132/53

[58] Field of Search ..... 132/53, 7, 5, 54, 55, 132/56

[56] References Cited

U.S. PATENT DOCUMENTS

| | | | |
|---|---|---|---|
| 3,077,891 | 2/1963 | Lane | 132/5 |
| 3,189,035 | 6/1965 | Heck | 132/5 |
| 3,421,521 | 1/1969 | Rich, Jr. | 132/5 |
| 3,589,376 | 6/1971 | Kohler | 132/53 X |
| 3,613,695 | 10/1971 | Kazdin | 132/53 |
| 4,456,019 | 6/1984 | Finamore | 132/53 X |
| 4,625,739 | 12/1986 | Hamazaki | 132/54 |
| 4,688,584 | 8/1987 | Nilsen | 132/53 X |

FOREIGN PATENT DOCUMENTS

| | | | |
|---|---|---|---|
| 376850 | 8/1907 | France | 132/53 |
| 2302056 | 10/1976 | France | 132/53 |
| 1494787 | 12/1977 | United Kingdom | 132/53 |

*Primary Examiner*—Richard J. Apley
*Assistant Examiner*—Robert W. Bahr
*Attorney, Agent, or Firm*—Fred Wiviott

[57] ABSTRACT

A wig comprises a soft plastic, impermeable cap individually molded to be complementary to the scalp of the intended wearer. A conventional wig is attached to the cap by a coupling consisting of a first strip of a feltlike material and a second strip of a material having a plurality of hooklike projections which is known as Velcro. One of the strips is attached to the cap and extends from front to rear and the second strip is affixed to the underside of a conventional wig.

6 Claims, 1 Drawing Sheet

WIG

BACKGROUND OF THE INVENTION

This invention relates to wigs and more particularly to wigs for persons suffering from complete hair loss.

Alopecia areata is a disorder which afflicts individuals of both sexes and all ages and is characterized by baldness occurring in sharply defined patches leaving the scalp smooth and white. It is common for individuals so afflicted to wear hairpieces or wigs to cover the areas of baldness. However, when such baldness is total, conventional wigs are not satisfactory because there is no residual hair for attachment. In such cases, the most common method is to employ adhesives, such as two-sided tapes, for attaching the wig directly to the bare scalp. Such attachment methods, are not secure so that many wearers are will at ease in social situations and tend to become withdrawn. Furthermore, because of a fear that their wigs will become dislodged, such individuals curb many physical activities such as athletics. As a result of the absence of satisfactory prior art wigs, total baldness can be psychologically devastating, particularly to women and girls. Additionally, such attachment methods as well as the underside of the wig itself can be uncomfortable and cause irritations, infections or itching. Furthermore, such conventional wigs tend to absorb perspiration which also causes a tendency to restrict activities.

One prior art attempt to remedy this problem was to employ a plastic cap to which individual hairs were attached so as to resemble a scalp. Such wigs were very expensive and were limited to the use of a single hairpiece which required a great deal of care.

SUMMARY OF THE INVENTION

It is an object of the invention to provide a new and improved wig.

Another object of the invention is to provide a wig which is relatively inexpensive and can be worn with comfort by persons suffering complete hair loss.

A further object of the invention is to provide a wig which is not easily dislodged from the scalp and which does not require the use of adhesives.

Yet another object of the invention is to provide a wig which does not absorb perspiration.

A still further object of the invention is to provide a wig which permits the use of different hairpieces.

These and other objects and advantages of the present invention will become more apparent from the detailed description thereof taken with the accompanying drawings.

In general terms, the invention comprises a wig having a soft plastic, impermeable cap individually molded to be complementary to the scalp of the intended wearer and a second flexible cap having hair like material attached to one side and a flexible attachment means consisting of a first strip of feltlike material and a second strip of a material having a plurality of hooklike projections, one of such strips being attached to the outer surface of the first cap and second one of said strips being attached to the underside of the second cap.

DETAILED DESCRIPTION OF THE PREFERRED EMBODIMENT

Figure 1:
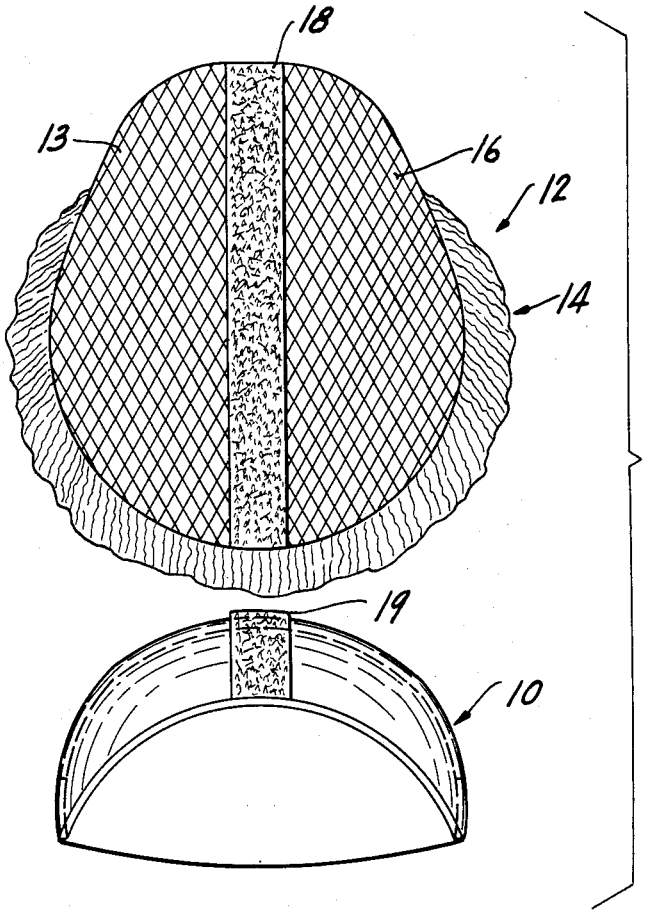
FIG. 1 is an exploded perspective view of the wig according to the preferred embodiment of the invention.
Figure 2:
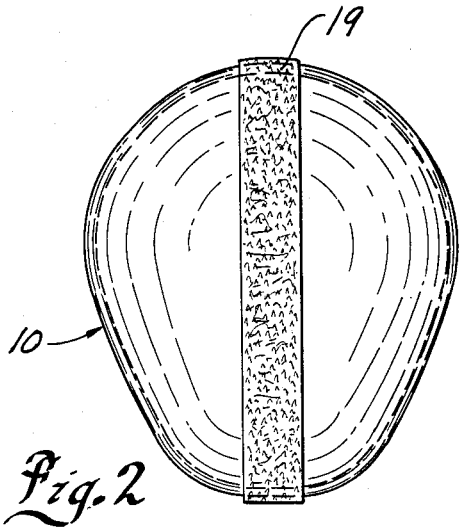
FIG. 2 is a top view of one portion of the wig shown in FIG. 1.
Figure 3:
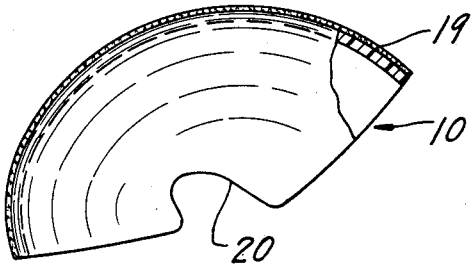
FIG. 3 is a side view of the wig portion shown in FIG. 2.

The wig according to the invention comprises a soft plastic impermeable cap 10 individually molded to the scalp of the intended wearer. In addition, a conventional wig 12 is suitably attached to a cap 10 in a manner which will be described below. The conventional wig may include a second cap portion 13 having a hairlike material 14 suitable attached to its upper surface. The lower surface of the cap 12 includes a netlike material 16 which would normally be placed in engagement with the scalp of the wearer.

The attachment means comprises a first flexible strip of material 18 suitable attached to the underside of the wig cap 12 and a second flexible strip 19 attached to the upper surface of the cap 10. Preferably, each of the strips extends from front to rear in each of the caps 10 and 16 and are substantially co-extensive. The attachment means is preferably the type called Velcro and consists of a first strip of a feltlike material and a second strip of material consisting of projecting hooklike formations which individually engage with the nap of the feltlike material. Preferably, the feltlike material is attached to the cap 10 and the strip consisting of projecting hooks is attached to the underside of the wig 12.

The cap 10 is formed of a low density polyurethane material which is formed on a mold of the wearer's skull. The mold is manufactured in a conventional manner such as by wrapping a plaster bandage around the skull to form a negative impression. After the plaster bandage has set, it is removed and a positive plaster mold is made from the negative image. The positive image is then rendered smooth by sanding. A nylon netting is placed over the mold to form a moisture barrier and a flat sheet of low density polyethylene contained in a surrounding metal frame is placed over the positive image and the two are then placed into an oven at a temperature of about 350°–375° F. The heated polyurethane becomes plastic and sags down over the positive image. A vacuum is then drawn under the metal frame so that the plastic material is forced tightly around the positive mold. The mold and polyurethane is then removed from the over and allowed to cool or is cooled by blowing air over its surface after which it is removed from the mold and the edges trimmed into the desired shape. Preferably, the cap 10 extends from the forehead backwardly to the base of the skull and downwardly along the sides with a cut-out portions 20 at each side corresponding to the location of the ears. The cap may then be fit to the wearer's skull and reshaped by heating localized areas with a heat gun. The adhesive strip 19 is then glued to its upper surface while a second strip 18 is sewn beneath the cap of a conventional wig.

Because the cap 10 fits closely to the wearer's skull, is in full contact with the skin and extends over a substantial portion thereof, it does not become dislodged easily and accordingly the wearer can engage in athletic or social events without the fear that the wig will fall off. Additionally, because the cap 10 is impermeable, the conventional wig 12 does not absorb perspiration. These benefits are psychologically uplifting to the wearer, who feels more at ease in social situations. Furthermore, because the relatively inexpensive wig 12 is detachable from the relatively more expensive cap 12, a plurality of different wigs 12 may be employed without substantial additional costs.

While only a single embodiment of the invention has been illustrated and described, it is not intended to be limited thereby but only by the scope of the appended claims.

I claim:

1. A wig for use by persons suffering complete or substantially complete hair loss, said wig comprising an impermeable plastic cap having an inner surface individually molded to be complementary to the scalp of the intended wearer, the inner surface of the cap being impermeable and constructed and arranged for directly engaging the scalp of the wearer along substantially its entire area to provide self-adhesion to the scalp without additional adhesive means, a conventional wig including a second flexible cap which is flexible and has upper and lower sides, a hairlike material affixed to the upper side of said second cap and releasable attachment means having first and second portions, and the first portion of said attachment means being affixed to the upper surface of said first cap and said second portion of said attachment means being affixed to the under surface of said second cap, the engagement of said first and second attachment portions releasably securing said conventional wig to said plastic cap, said inner surface forming the sole means for mounting and securing said wig to the wearer's scalp.

2. The wig set forth in claim 1 wherein said attachment means comprises a first strip of a feltlike material and a second strip of a material having a plurality of hooklike projections which snag said feltlike material for releasable attachment thereto.

3. The wig set forth in claim 2 wherein said first strip of material is affixed to said plastic cap and the second strip of material is affixed to said second cap.

4. The wig set forth in claim 3 wherein said strips of material are complementary and extend from front to rear and generally centrally of each of said caps.

5. The wig set forth in claim 4 wherein said plastic cap is molded from a positive image of the wearer's skull.

6. The wig set forth in claim 5 wherein said plastic cap is constructed and arranged to cover the wearer's skull from the forehead backwardly to the base of the skull and downwardly along the sides thereof.

* * * * *